US006093102A

United States Patent [19]

Bennett

[11] Patent Number: 6,093,102

[45] Date of Patent: Jul. 25, 2000

[54] MULTILINE GAMING MACHINE

[75] Inventor: Nicholas Luke Bennett, Manly Vale, Australia

[73] Assignee: Aristocrat Leisure Industries Pty Ltd, Lane Cove Zoff, Australia

[21] Appl. No.: 08/809,658

[22] PCT Filed: Sep. 12, 1995

[86] PCT No.: PCT/AU95/00598

§ 371 Date: Mar. 15, 1997

§ 102(e) Date: Mar. 15, 1997

[87] PCT Pub. No.: WO96/08799

PCT Pub. Date: Mar. 21, 1996

[30] Foreign Application Priority Data

Sep. 15, 1994 [AU] Australia ..... PM8161

[51] Int. Cl.[7] ..... G07F 17/34

[52] U.S. Cl. ..... 463/20; 463/16; 273/138.1

[58] Field of Search ..... 463/16, 20, 21; 273/138.1, 142 R, 142 B, 143

[56] References Cited

U.S. PATENT DOCUMENTS

| | | | |
|---|---|---|---|
| Re. 34,244 | 5/1993 | Hagiwara | 463/20 |
| 5,580,053 | 12/1996 | Crouch | 463/20 |

FOREIGN PATENT DOCUMENTS

| | | |
|---|---|---|
| 82126 | 6/1975 | Australia . |
| 2119989 | 5/1982 | United Kingdom . |
| 2137392 | 2/1983 | United Kingdom . |
| 2150844 | 12/1984 | United Kingdom . |
| 2187320 | 2/1987 | United Kingdom . |
| 2258334 | 7/1992 | United Kingdom . |

*Primary Examiner*—Jessica J. Harrison
*Assistant Examiner*—John M. Hotaling, II
*Attorney, Agent, or Firm*—Rosenman & Colin LLP

[57] ABSTRACT

A gaming machine has a display which displays a symbols in an array format of n rows and m columns of symbol positions. A game control controls images displayed on the display and is arranged to pay a prize when a predetermined combination of symbols is displayed in a predetermined arrangement of symbol positions including one and only one symbol position in each column of the array. The number of said predetermined arrangements in the gaming machine for any one game is a value which is the product $k_1 \ldots \times \ldots k_i \ldots \times \ldots k_m$, where $k_i$ represents a number of symbol positions which have been selected by the player in an $i^{th}$ column of the n rows by m columns of symbol positions on the display ($0<i\leqq m$ and $k_i \leqq n$). At least one symbol position is selected from each column, and the number of predetermined arrangements represents the number of possible combinations of the selected symbol positions which have one symbol position in each column of the display means.

12 Claims, 4 Drawing Sheets

MULTILINE GAMING MACHINE

IMPROVED MULTILINE GAMING MACHINE

The present invention relates to gaming machines of the type generally referred to as slot machines, fruit machines or poker machines, and in particular the invention provides an improvement to a game played on such a machine.

Players who regularly play gaming machines quickly tire of particular games and therefore it is necessary for manufacturers of these machines to come up with innovative game features that add interest to the games provided on such machines in order to keep the players amused and therefore willing to continue playing the game.

DESCRIPTION OF THE PRIOR ART

Gaming or poker machines have been well known in the state of New South Wales for many years and have more recently gained considerable popularity throughout Australia, with quite substantial amounts of money wagered on these machines. There is a growing tendency for State governments to legalise the use of gaming machines by licensing operators, with resulting revenue gains through licence fees and taxation of monies invested. The licensed operation of gaming machires is the subject of State legislation and regulation. This regulation most always dictates a minimum percentage payout for a gaming machine. For example, a minimum of 85% of monies invested must be returned as winnings, and manufacturers of gaming machines therefore must design their machines around these regulatory controls.

With the growth that has occurred in the gaming machine market there is intense competition between manufacturers to supply the various existing and new venues. When selecting a supplier of gaming machines, the operator of a venue will often pay close attention to the popularity of various games with their patrons.

Therefore, gaming machine manufacturers are keen to devise games which are popular with players, as a mechanism for improving sales.

Many various strategies have been tried in the past to make games more enticing to players, and these strategies are often aimed at either increasing the maximum prize payable on a machine or creating at least the perception of more winning opportunities. The present invention falls into the latter category. For quite a few years, it has been possible to bet on more than one pay line of a slot machine simultaneously. However this feature has been restricted by the number of pay lines that could be achieved on the display format commonly used in slot machines.

Originally, the term "pay line" included within its scope only straight line arrangements of symbol locations (e.g. horizontal lines, and diagonals in 3×3 machines). In fact original slot machines only paid on the horizontal centreline of symbol locations.

In the more recent past "pay lanes" have been devised which are not straight line arrangements of symbol locations although these more recent payline arrangements have still included only symbol locations that were horizontally or diagonally adjacent to one another and always included only one location in each column of the display.

In embodiments of the present invention, paying symbol arrangements are proposed in which symbol locations in adjacent columns of the display are not necessarily horizontally or diagonally adjacent to one another. Throughout this specification these new paying symbol arrangements are still referred to as "pay lines" although in the conventional sense they are not strictly lines at all.

The present invention provides an arrangement whereby the number of pay lines provided on a slot machine, particularly a machine with 3×5 display, can be increased without changing the display format.

SUMMARY OF THE INVENTION

The present invention consists in a gaming machine having display means arranged to display a plurality of symbols in an array of n rows and m columns of symbol positions, game control means arranged to control images displayed on the display means the game control means being arranged to pay a prize when a predetermined combination of symbols is displayed Ln a predetermined arrangement of symbol positions including one and only one symbol position in each column of the array, the gaming machine being characterised in that the number of said predetermined arrangements for any one game is a value which is the product $k_1 \ldots k_i \ldots k_m$ where $k_i$ represents a number of symbol positions which have been selected by the player in an $i^{th}$ column of the display ($0<i\leqq m$), at least one symbol position being selected from each column, and the number of predetermined arrangements being the number of possible combinations of the selected symbol positions which have one symbol position in each column of the display means.

The preferred embodiments of the invention use a display means which displays symbols in 3 rows and 3, 4 or 5 columns.

In a particular embodiment the number of predetermined symbol arrangements for any one game is a value $n^j$ where j is less than or equal to m, is directly or indirectly player selectable and represents a selected number of columns of the display means whereby each predetermined arrangement is made up of m symbol positions one selected from each of the m columns, the predetermined arrangement used for a given value of j being all possible combinations using one symbol position from each of j selected columns of the display means combined with the symbol positions in a predetermined row from the remaining m−j columns.

In this embodiment, rather than individually selecting symbol positions, a player will select columns of symbol positions as a group. This arrangement has the advantage that the selection mechanism is simplified.

Preferably the display format will have three rows and the predetermined row from which the remaining m−j symbol positions are selected is a centre row.

Preferably also the j columns will be a left most j columns of the display means.

The invention is equally applicable to video machines and machines employing spinning reels.

BRIEF DESCRIPTION OF THE DRAWINGS

Embodiments of the present invention will now be described by way of example with reference to the accompanying drawings in which.

DETAILED DESCRIPTION OF THE PREFERRED EMBODIMENTS

In the following detailed description, the methodology of the embodiments will be described and it is to be understood that it is within the capabilities of the non-inventive worker in the art to introduce the methodology on any standard microprocessor base gaming machine by means of appropriate programming.

Traditional slot machines have made use of spinning reels to provide a display function with symbols carried on the reels being aligned to produce a game result which may or may not be a winning combination. Traditionally such machines paid a prize only on a centre row combination, however over the years more complex pay arrangements have been developed in which winning combinations could appear on horizontal lines above and follow the centre row line, and later on diagonal lines (typically on 3 reel machines).

In more recent times video displays have been used to simulate spinning reels on these types of machines and in some instances machines have been provided with matrices of pseudo spinning wheels such as a 3×3 matrix of reels, whereby every single position on the display screen is essentially independently randomly achieved and therefore it was valid to pay on vertical combinations as well as horizontal combinations. In such a machine with a 3×3 symbol matrix display, winning combinations could be achieved on any one of three horizontal pay lines, three vertical paylines and two diagonals, making 8 possible lines on which a result could be assessed.

It is normal for machines of the type having multiple pay lines available, that the player would purchase the option of playing for a win on lines other than the centre line. That is to say, if the player wagered only one token he played only for a winning combination on one line, whereas if he wagered a number of tokens he may well select to wager Some of those tokens on lines other than the centre line of the display.

This mechanism adds interest to the game being played by the player as essentially it enables him to make multiple bets simultaneously.

Figure 1:
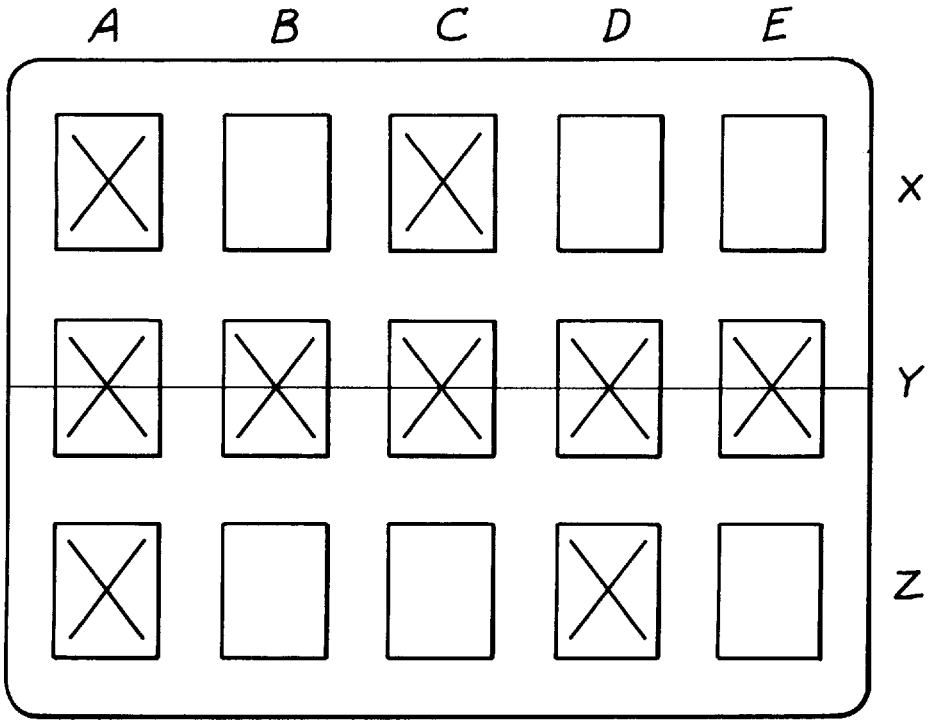
FIGS. 1,2,3 and 4 diagrammatically illustrates four possible embodiments of a 243 line multi-line pay arrangement for a machine with a 3×5 display format.

Referring to FIG. 1, a matrix symbolic of a typical three line by five column display matrix is illustrated, and it will be immediately apparent that in such an arrangement diagonal pay lines as conventionally used in 3×3 symbol matrix machines are not appropriate to the 3×5 format. Similarly, in slot machines which play games which follow the traditional format of a plurality of vertical spinning reels, vertical pay lines are not appropriate as there is no significant degree of randomness in the combinations provided on the vertical line.

Therefore, with this in mind the first embodiment of the present invention provides an arrangement for a slot machine having a 3×5 symbol matrix display with 243 possible pay lines being all possible combinations of symbol positions which include one position in each column of the display.

Referring to FIG. 1 a 3×5 display matrix is illustrated and in this embodiment a player may select the symbol positions to be included in their pay line combinations. If the symbol positions marked with an 'x' in FIG. 1 are selected by the player (ie AX, AY, AZ, BY, CX, CY, DY, DZ, EY) then the corresponding pay lines will be as shown in Table 1.

TABLE 1

| LINE NO | DISPLAY POSITIONS USED | | | | |
|---|---|---|---|---|---|
| 1 | AX | BY | CX | DY | EY |
| 2 | AX | BY | CX | DZ | EY |
| 3 | AX | BY | CY | DY | EY |
| 4 | AX | BY | CY | DZ | EY |

TABLE 1-continued

| LINE NO | DISPLAY POSITIONS USED | | | | |
|---|---|---|---|---|---|
| 5 | AY | BY | CX | DY | EY |
| 6 | AY | BY | CX | DZ | EY |
| 7 | AY | BY | CY | DY | EY |
| 8 | AY | BY | CY | DZ | EY |
| 9 | AZ | BY | CX | DY | EY |
| 10 | AZ | BY | CX | DZ | EY |
| 11 | AZ | BY | CY | DY | EY |
| 12 | AZ | BY | CY | DZ | EY |

It will be seen that the number of lines produced is given by the product $$k_1 \times k_2 \times k_3 \times k_4 \times k_5$$

where $k_i$ is the number of symbol positions selected in the $i^{th}$ column of the machine. For an m column display the number of lines would be represented by the product $$k_1 \times k_2 \times \ldots \times k_i \times \ldots \times k_m.$$

Figure 2:
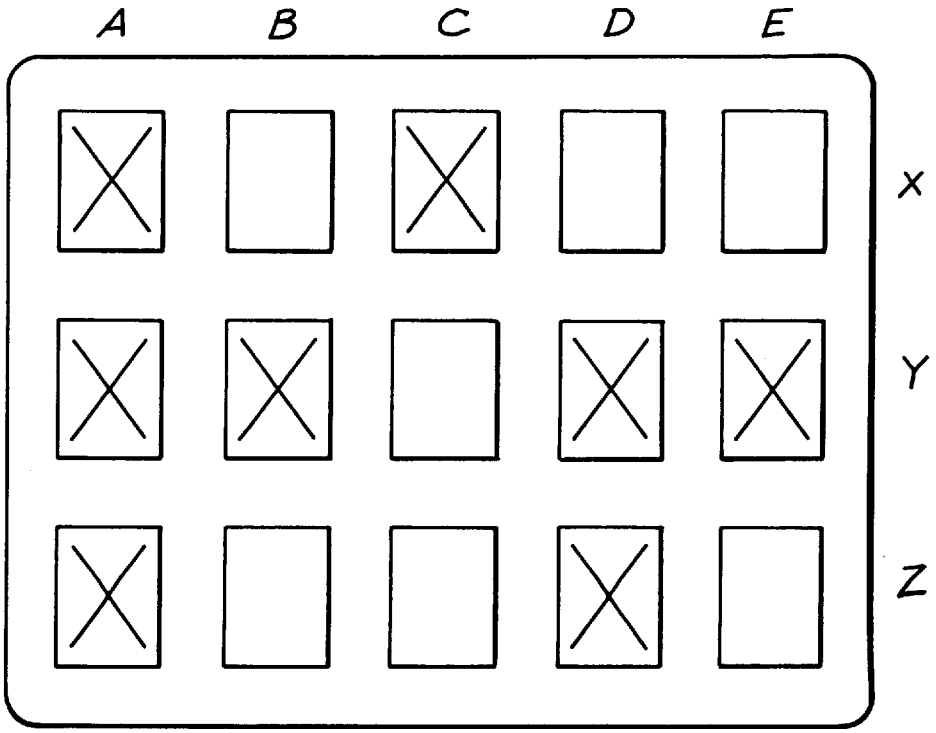

In the embodiment of FIG. 1 the centre line symbol positions are always selected, however it is also possible to produce embodiments in which any single symbol position might be selected in each column and such an embodiment is illustrated in FIG. 2. In this embodiment lines 1,2,5,6,9 and 10 defined in Table 1 will be effective for the symbol positions selected (as marked with a 'x'). In the embodiment of FIG. 2 the selection would default to the centre line position in the event that no symbol was selected in a particular column.

Selection of symbol positions for inclusion on pay lines may be achieved using a number of methods such as placing a touch sensitive layer over each symbol position in the display, or providing a matrix of buttons corresponding to the display matrix format.

Figure 3:
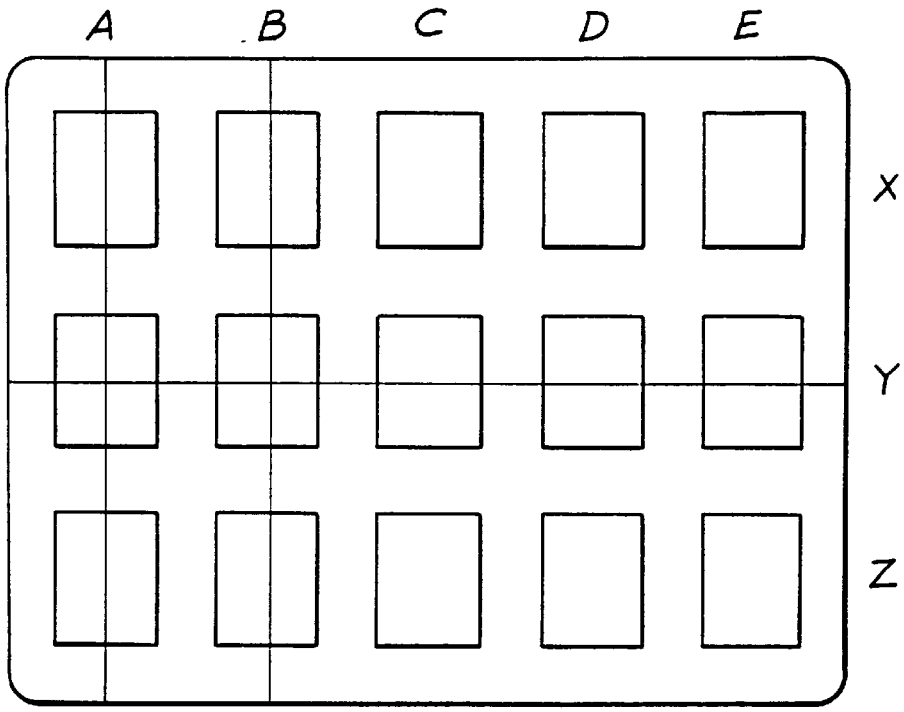
Figure 4:
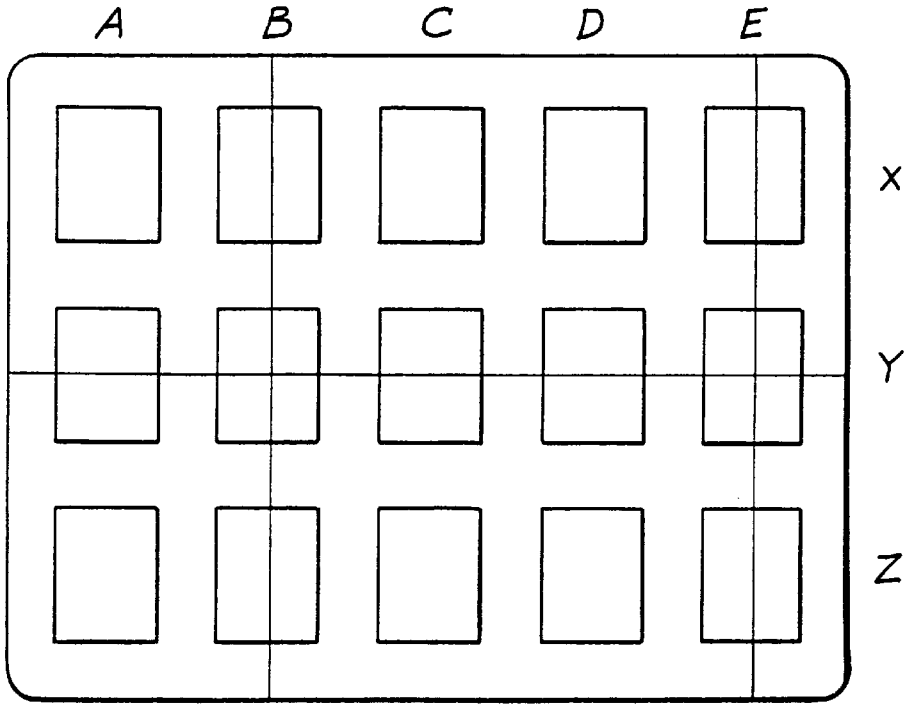

FIGS. 3 and 4 illustrate a simplified version of the invention in which players may select columns of symbol positions to be included in their pay line combinations. These embodiments are simpler than those previously described because only one selection mechanism is required per display column. Selection might be by way of touch sensitive membrane over the display or by way of a switch under each column.

In the embodiment of FIG. 3 columns must be selected from the left such that if 3 lines are required column A is selected, if 9 lines are required column B is selected (and column A will be automatically selected), and similarly for 27 lines (column C), 81 lines (column D) and 243 lines (column E). The lines provided when 9 lines are selected are defined in Table 2.

TABLE 2

| LINE NO | DISPLAY POSITIONS USED | | | | |
|---|---|---|---|---|---|
| 1 | AX | BX | CY | DY | EY |
| 2 | AX | BY | CY | DY | EY |
| 3 | AX | BZ | CY | DY | EY |
| 4 | AY | BX | CY | DY | EY |
| 5 | AY | BY | CY | DY | EY |
| 6 | AY | BZ | CY | DY | EY |
| 7 | AZ | BX | CY | DY | EY |
| 8 | AZ | BY | CY | DY | EY |
| 9 | AZ | BZ | CY | DY | EY |

In the embodiment of FIG. 4 there is no restriction on which columns are selected and therefore the player must indicate each column to be included. The lines selected in FIG. 4 are defined in Table 3.

TABLE 3

| LINE NO | DISPLAY POSITIONS USED | | | | |
|---|---|---|---|---|---|
| 1 | AY | BX | CY | DY | EX |
| 2 | AY | BX | CY | DY | EY |
| 3 | AY | BX | CY | DY | EZ |
| 4 | AY | BY | CY | DY | EX |
| 5 | AY | BY | CY | DY | EY |
| 6 | AY | BY | CY | DY | EZ |
| 7 | AY | BZ | CY | DY | EX |
| 8 | AY | BZ | CY | DY | EY |
| 9 | AY | BZ | CY | DY | EZ |

It will be seen that the number of lines produced in the embodiments of FIGS. 3 and 4 is given by $$n^j$$

where n is the number of display rows and j is the number of columns selected ($0 \leqq j \leqq m$)

Figure 5:
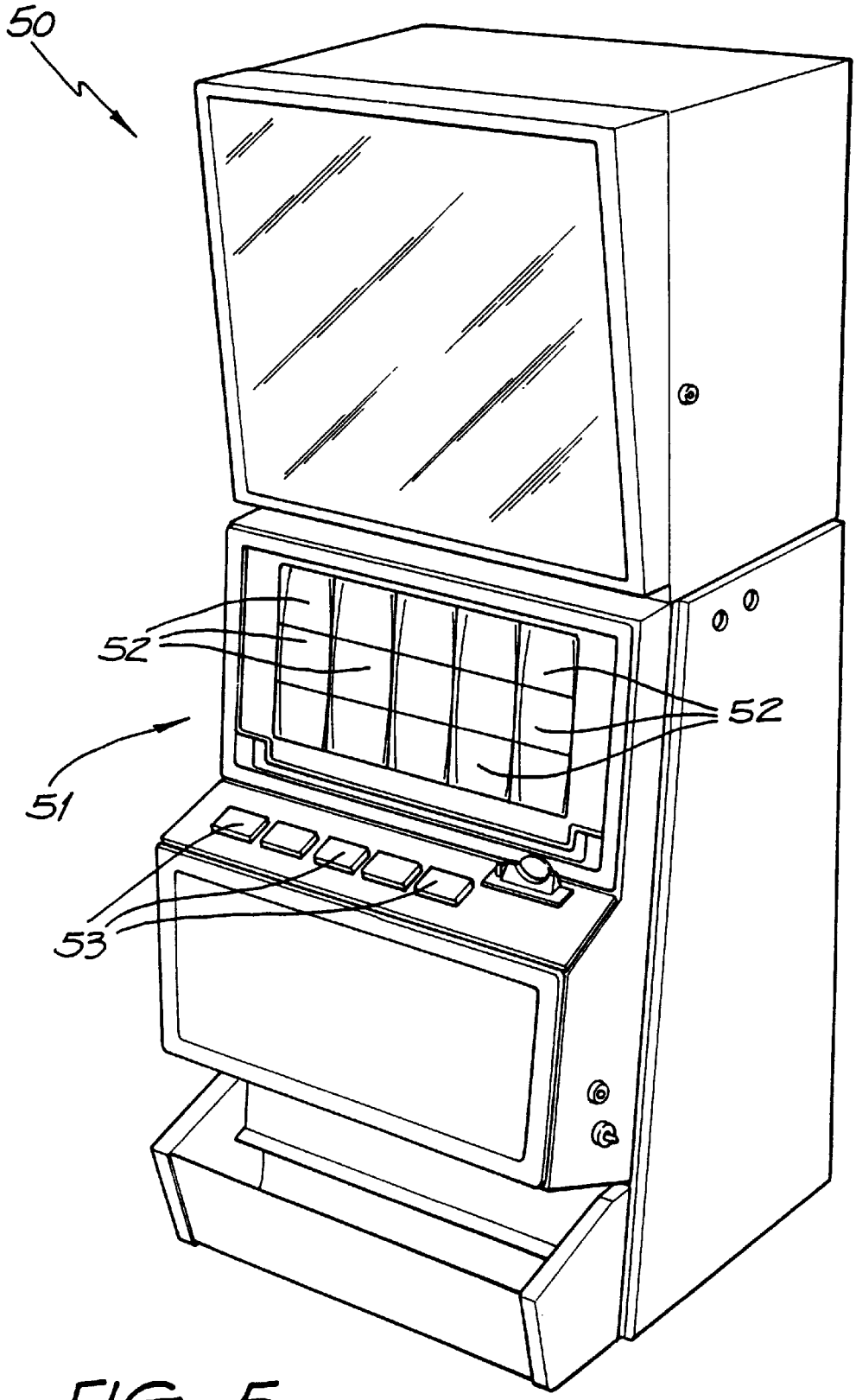
FIGS. 5 and 6 illustrate two possible machine configurations in which the games described with reference to FIGS. 1 to 4 may be employed.

Referring to FIG. 5, a slot machine 50 is illustrated in which symbol positions are selected for inclusion in pay lines by way of a touch sensitive membrane applied over the display screen 51, the membrane being divided into a number of switch panels 52 each of which corresponds with one display position of the display 51. This arrangement can be used to implement the embodiments described with reference to FIGS. 1 and 2.

Each vertical set of touch sensitive panels 52 can be operated in parallel in the embodiments of FIGS. 3 and 4, such that columns of display positions can be selected by touching any switch over the respective column. Alternatively, each set of three vertically aligned switches may be implemented as a single touch panel running over the entire column of display positions.

When implementing the embodiments described with reference to FIGS. 3 and 4, it is also possible to dispense with the touch switches and use the switches 53 located below the display area.

The machine of FIG. 5 is illustrated with a video display but may also make use of a display comprising a plurality of stepping motor driven reels carrying a plurality of symbols.

Figure 6:
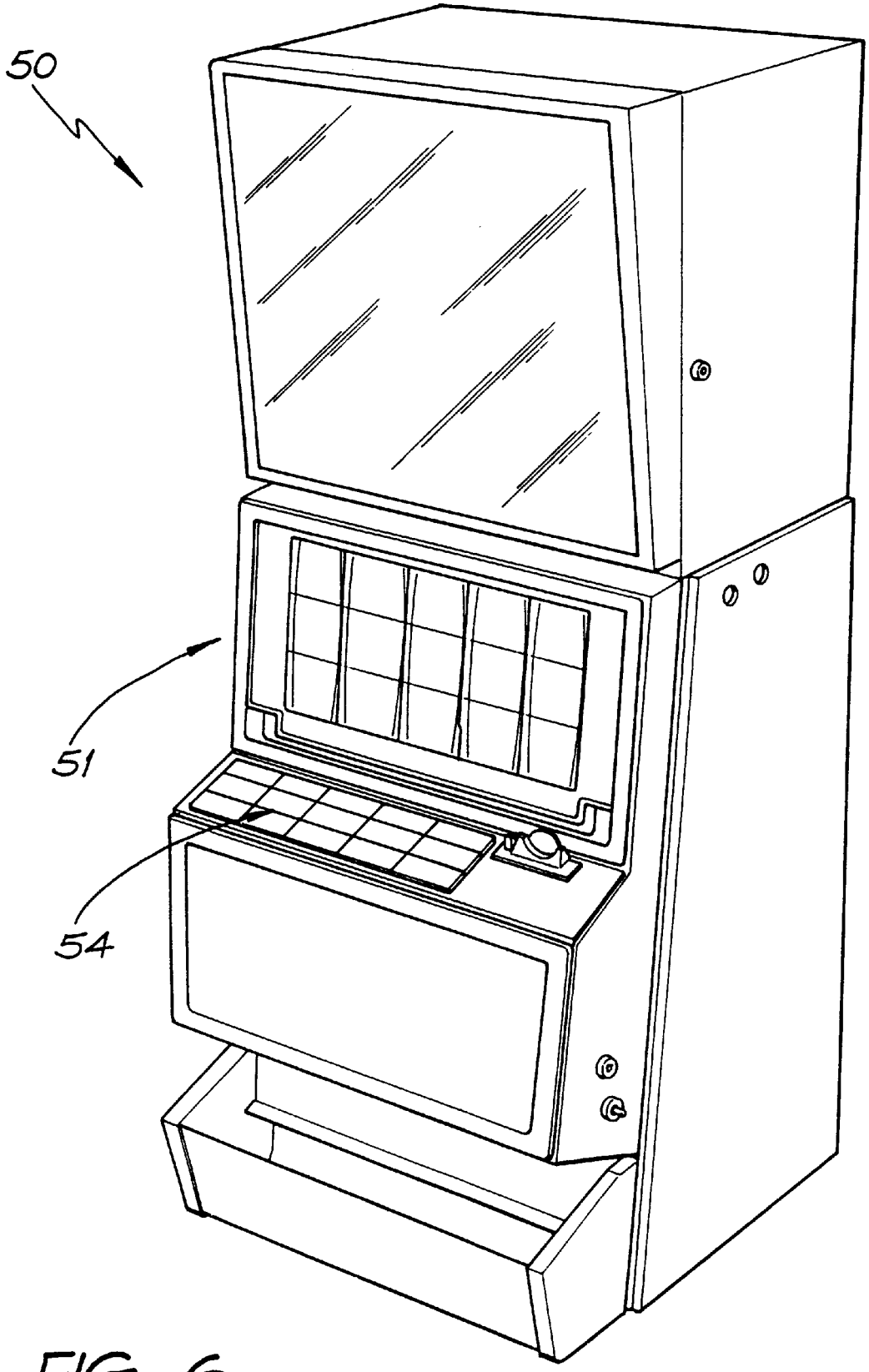

Turning now to FIG. 6, a further slot machine configuration is shown in which the slot machine 50 is provided with a display 51, which may be either a video display or a stepper motor driven reel display and a matrix of switches 54 corresponding to the format of the display matrix, such that symbol positions can be selected by use of the matrix 54 to define the pay lines applicable for a game played on the machine. This arrangement can be used for the embodiments described with reference to FIGS. 1 and 2.

It will be recognised that other switch configurations may also be employed which multiplex switch functions to reduce the number of switches required.

It will also be appreciated by persons skilled in the art that numerous variations and/or modifications may be made to the invention as shown in the specific embodiments without departing from the spirit or scope of the invention as broadly described. The present embodiments are, therefore, to be considered in all respects as illustrative and not restrictive.

What is claimed is:

1. A gaming machine having display means arranged to display a plurality of symbols in a display format having an array of n rows and m columns of symbol positions, game control means arranged to control images displayed on the display means, the game control means being arranged to pay a prize when a predetermined combination of symbols is displayed in a predetermined arrangement of symbol positions selected by a player, playing a game, including one and only one symbol position in each column of the array, the gaming machine being characterised in that selection means are provided to enable the player to control a definition of one or more predetermined arrangements by selecting one or more of the symbol positions and the control means defining a set of predetermined arrangements for a current game comprising each possible combination of the symbol positions selected by the player which have one and only one symbol position in each column of the display means, wherein the number of said predetermined arrangements for any one game is a value which is the product $k_1 \ldots \times \ldots k_i \ldots \times \ldots k_m$ where $k_i$ is a number of symbol positions which have been selected by the player in an $i^{th}$ column of the n rows by m columns of symbol positions on the display ($0 < i \leqq m$ and $k_i \leqq n$).

2. The gaming machine as claimed in claim 1 wherein the selection means provides means for selection of each column of symbols as a group and the number of predetermined arrangements for any one game is a value $n^j$ where j is less than or equal to the number of m columns of symbol position and is a number of columns selected for that game, the selected columns being directly or indirectly selectable by the player whereby each predetermined arrangement is made up of one symbol position selected from each of the m columns to give a total number of selected symbol positions p in each predetermined arrangement, where p=m, the predetermined arrangements used for a given value of j being all possible combinations using one symbol position from each of the j selected columns of the display means combined with the symbol positions in a predetermined row from the remaining m−j columns.

3. The gaming machine of claim 2, wherein the display format has three rows and the predetermined row from which the symbol positions are selected in the remaining m−j columns of symbol positions is a center row.

4. The gaming machine of claim 2 wherein the j columns are the left most j columns of the display means.

5. The gaming machine of claim 3 wherein the display means is arranged to display symbols in 3 rows and 3 columns.

6. The gaming machine of claim 3 wherein the display means is arranged to display symbols in 3 rows and 4 columns.

7. The gaming machine of claim 3 wherein the display means is arranged to display symbols in 3 rows and 5 columns.

8. The gaming machine as claimed in claim 1 wherein the player is able to select any number of symbol positions in any column of the display with a predetermined position being selected by the machine in any column in which the player does not make a selection, and where the predetermined arrangements used in a given game are all possible combinations of the selected symbol position having one and only one position in each column of the display.

9. The gaming machine of claim 8 wherein the predetermined positions selected by the machine are in the centre row of the display.

10. The gaming machine of claim 9 wherein the display means is arranged to display symbols in 3 rows and 3 columns.

11. The gaming machine of claim 9 wherein the display means is arranged to display symbols in 3 rows and 4 columns.

12. The gaming machine of claim 9 wherein the display means is arranged to display symbols in 3 rows and 5 columns.

* * * * *